US009677350B2

(12) United States Patent
Kunec

(10) Patent No.: US 9,677,350 B2
(45) Date of Patent: Jun. 13, 2017

(54) FILL UP AND CIRCULATION TOOL AND METHOD OF OPERATING

(71) Applicant: Canrig Drilling Technology Ltd., Houston, TX (US)

(72) Inventor: Alex Kunec, Tomball, TX (US)

(73) Assignee: Canrig Drilling Technology Ltd., Houston, TX (US)

( * ) Notice: Subject to any disclaimer, the term of this patent is extended or adjusted under 35 U.S.C. 154(b) by 312 days.

(21) Appl. No.: 14/537,391

(22) Filed: Nov. 10, 2014

(65) Prior Publication Data

US 2015/0129198 A1 May 14, 2015

Related U.S. Application Data

(60) Provisional application No. 61/902,573, filed on Nov. 11, 2013.

(51) Int. Cl.

| | |
|---|---|
| ***E21B 21/10*** | (2006.01) |
| ***E21B 17/10*** | (2006.01) |
| *E21B 34/00* | (2006.01) |

(52) U.S. Cl.

CPC ..... *E21B 17/1078* (2013.01); *E21B 21/106* (2013.01); *E21B 2034/007* (2013.01)

(58) Field of Classification Search

CPC ..... E21B 21/10; E21B 21/106

See application file for complete search history.

(56) References Cited

U.S. PATENT DOCUMENTS

| | | | | |
|---|---|---|---|---|
| 6,173,777 | B1 | 1/2001 | Mullins | |
| 6,832,656 | B2 | 12/2004 | Fournier, Jr. et al. | |
| 8,141,642 | B2 | 3/2012 | Olstad et al. | |
| 2002/0096334 | A1* | 7/2002 | LaFleur | E21B 21/106 166/334.4 |
| 2008/0196889 | A1* | 8/2008 | Bour | E21B 33/14 166/250.14 |
| 2010/0032162 | A1* | 2/2010 | Olstad | E21B 19/16 166/305.1 |
| 2010/0206584 | A1* | 8/2010 | Clubb | E21B 19/08 166/380 |

* cited by examiner

*Primary Examiner* — George Gray

(74) *Attorney, Agent, or Firm* — Enrique Abarca; Abel Law Group, LLP

(57) ABSTRACT

A fill-up and circulation tool includes a central assembly including a mandrel, a nose assembly disposed at a terminal end of the mandrel, an outer assembly coupled to the central assembly, and a valve configured to change position between a closed position and an open position, wherein changing position between the closed position and the open position includes movement of the outer assembly relative to the central assembly.

20 Claims, 5 Drawing Sheets

FILL UP AND CIRCULATION TOOL AND METHOD OF OPERATING

CROSS-REFERENCE TO RELATED APPLICATION(S)

This application claims priority under 35 U.S.C. §119(e) to U.S. Patent Application No. 61/902,573 entitled "Fill Up and Circulation Tool and Method of Operating," by Alex Kunec, filed Nov. 11, 2013, which is assigned to the current assignee hereof and incorporated herein by reference in its entirety.

BACKGROUND

Field of the Disclosure

The following is directed to a fill up and circulation tool for use in subterranean operations.

Description of the Related Art

In the process of removing materials (e.g., oil or gas) from subterranean formations, a wellbore is typically drilled to a predetermined depth using a drill string having a drill bit attached to its lower end. Part of the drilling process includes a casing running operation, which involves removing the drill string from the wellbore, and lowering the casing into the wellbore as a liner. The casing may be a casing section or, in the alternative, a casing string including two or more casing sections connected to one another.

During the casing running operation, the pressure within the wellbore can become higher than the pressure within the bore of the casing. This higher pressure within the wellbore exerts stress on the casing as it is being lowered into the wellbore, thereby risking damage or collapse of the casing during run-in. A casing fill-up operation is performed to mitigate these stresses. The casing fill-up operation involves filling the bore of the casing being run into the wellbore with a fluid (such as "mud") in an attempt to equalize the pressure inside the casing with the pressure outside the casing (i.e., the pressure within the wellbore) and thereby prevent collapse of the casing during the run-in operation. Pressurized fluid is typically input into the bore of the upper end of the casing using a fill line from the existing mud pumps at the well site.

At various times during the casing running operation, the casing may get stuck within the wellbore. To dislodge the casing from the wellbore, a circulating operation is performed by utilizing a circulation tool, where pressurized drilling fluid is circulated down the casing and out into the annulus to remove the obstructing debris. For a circulating operation, the circulating tool is inserted into the bore of the casing at the upper end of the casing. A sealing member on the circulating tool is typically activated to seal the circulating tool with the casing, forming a path for fluid flow through the circulating tool and out into the bore of the casing. Specifically, in a circulation operation, fluid is introduced into the circulating tool, flows through the bore of the casing and out the lower end of the casing to remove the obstructing debris, and then the fluid having the debris therein flows up the annulus back to the surface of the well.

After the circulation operation, the circulating tool is removed from the casing, and the casing fill-up operation may be restarted to run casing into the wellbore. During the casing running and fill-up operations, air is allowed to escape through the bore of the casing to prevent overpressurizing the bore of the casing. To vent the air from the bore of the casing, the circulating tool is removed from the casing prior to the fill-up operation. To remove the circulating tool, the sealing member is de-activated, and the circulating tool is lifted from the bore of the casing. The casing may then be lowered further into the wellbore while filling the casing with fluid to prevent collapse of the casing.

There is, therefore, a continuing need for a fill up tool suitable for fill up operations while maintaining capacity to properly and repeatedly create a seal and deliver fluids.

SUMMARY

According to a first aspect, a fill-up and circulation tool includes a central assembly including a mandrel, a nose assembly disposed at a terminal end of the mandrel, an outer assembly coupled to the central assembly, and a valve configured to change position between a closed position and an open position, wherein changing position between the closed position and the open position includes movement of the outer assembly relative to the central assembly.

In another aspect, a fill-up and circulation tool includes a central assembly including a mandrel and a nose assembly disposed at a terminal end of the mandrel, an outer assembly coupled to the central assembly including a biasing member disposed between a portion of the mandrel and an exterior sleeve and a valve configured to change position between a closed position and an open position. The tool further includes an annular sealing channel between a surface of the central assembly and an interior surface of the outer assembly, and wherein the valve is configured to be biased to the closed position until a predetermined pressure difference is exceeded between a pressure applied by a fluid in the central assembly relative to an atmospheric pressure.

For yet another aspect, a fill-up and circulation tool includes a central assembly including, a mandrel and a nose assembly disposed at a terminal end of the mandrel, an outer assembly coupled to the central assembly, and a valve configured to change position between a closed position and an open position. The tool further includes an annular sealing channel between a surface of the central assembly and an interior surface of the outer assembly, wherein in the closed position, the annular sealing channel defines a sealing channel volume (Vsc) between a surface of the central assembly and the outer assembly configured to regulate the position of the central assembly relative to the outer assembly based on the pressure of fluid within the sealing channel relative to an atmospheric pressure.

According to another aspect, a method of operating a fill-up and circulation tool includes placing the fill-up and circulation tool in a tubular, the fill-up and circulation tool having a central assembly including an outer assembly coupled to the central assembly and a valve configured to change position between a closed position and an open position. The method of operation the tool further includes moving the valve of the fill-up and circulation tool between a closed position and an open position by changing a sealing ratio (Fb/Ff) from at least 1 to not greater than 0.99, wherein Fb represents a force configured to be applied by a biasing member against the central assembly and Ff represents a force configured to be applied by a fluid contained in the central assembly against the outer assembly.

BRIEF DESCRIPTION OF THE DRAWINGS

The present disclosure may be better understood, and its numerous features and advantages made apparent to those skilled in the art by referencing the accompanying drawings.

DETAILED DESCRIPTION

Figure 8:
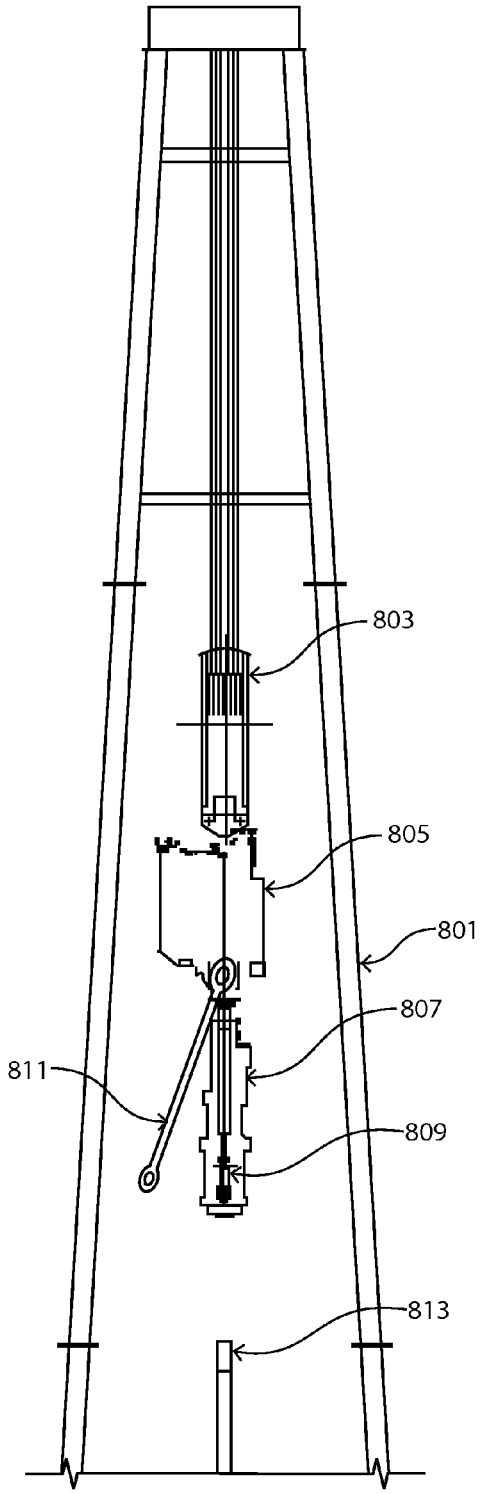
FIG. 8 includes an illustration of a portion of a drilling derrick including a fill-up and circulation tool in accordance with an embodiment.

The following disclosure is directed to a fill up and circulation tool used in subterranean operations, including for example, drilling operations for sourcing oil and gas. Referring briefly to FIG. 8, an illustration of a portion of a drilling derrick including a fill-up and circulating tool in accordance with an embodiment, As illustrated, system can include a drilling derrick 801 that can provide a structure for holding and operation of the tools used in the drilling operation. The system 800 can further include a traveling block 803 facilitating the movement of a top drive 805 on the derrick 801. As illustrated, the top drive 805 can be coupled to the traveling block 803 and move vertically within the derrick 801. The system can further include a gripping apparatus 807 and a fill-up and circulation tool 809 coupled to the top drive 805. Additionally, in some instances, the top drive 805 can further include elevator links 811. The fill up and circulation tool 809 may be positioned above a casing stump 813, which may extend above a floor of the derrick 801 and may be operably coupled to the casing stump during particular operations.

Figure 1:
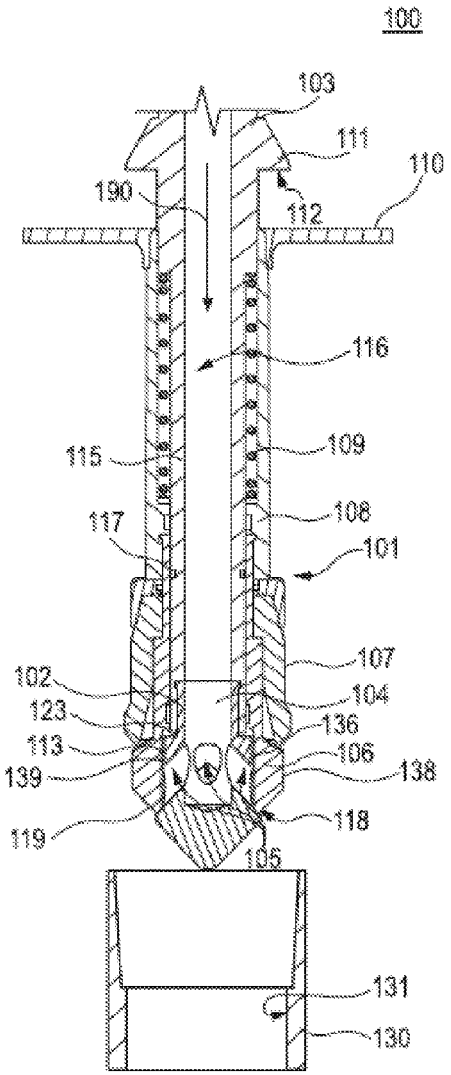
FIG. 1 includes a cross-sectional illustration of a fill-up and circulation tool in a closed position in accordance with an embodiment.

FIG. 1 includes a cross-sectional illustration of a fill-up and circulation tool in a closed position in accordance with an embodiment. In further detail, as illustrated in FIG. 1, the fill-up and circulation tool 100 can include an outer assembly 101 coupled to a central assembly 102. In one embodiment, the outer assembly 101 may include a centralizer 106. In accordance with an embodiment, the centralizer 106 may be coupled to the outer assembly 101, and more particularly, may be a component making up the outer assembly 101. In accordance with an embodiment, the centralizer 106 may facilitate alignment of the tool 100 within a tubular 130. More particularly, at least a portion of the centralizer 106, such as the outer surface 138 of the centralizer 106 can be configured to engage in interior surface 131 of the tubular 130 upon insertion of the tool 100 into the tubular 130.

In another embodiment, the outer assembly 101 may also include a packer 107 coupled to the centralizer 106. As further illustrated, in certain embodiments, the tool 100 can include a packer 107 as part of the outer assembly 101. In certain instances, the packer 107 can be configured to form a seal between an interior surface 131 of the tubular 130 and and the outer assembly 101 to facilitate proper delivery of a fluid into the tubular and limiting leakage of the fluid out of the tubular at the insertion point of the tool 100.

In particular embodiments, the outer assembly 101 can include a packer 107 disposed around at least a portion of the mandrel 103. More particularly, the packer 107 can have an outer diameter, defined as the largest diameter of the packer 107 through the center of the tool and perpendicular to the longitudinal direction 190, which can be greater than an outer diameter of centralizer 106. Such design can facilitate proper coupling of the outer surface of the packer and the interior surface 131 of the tubular 130 and proper formation of a seal upon insertion of the tool 100 in the tubular 130.

For certain designs, the tool 100 as illustrated in FIG. 1, may also include a sleeve 108 coupled to the packer 107. At least one design of the embodiments herein may also include a sleeve lip disposed between the sleeve 108 and packer 107. Moreover, in certain instances, the outer assembly 101 may include a push plate 110 coupled to a distal end of the sleeve 108.

As further illustrated, the central assembly 102 may include a mandrel 103 having an internal passage 116 extending longitudinally through the length of the mandrel 103 from a distal end to a terminal end of the mandrel 103. The mandrel 103 can be configured to facilitate flow of fluid through the interior channel 116. As further illustrated, the central assembly 102 can further include a nose assembly 104 coupled to a terminal end of the mandrel 103. Notably, the nose assembly 104 can include openings 105 configured to facilitate the flow of fluid from the nose assembly 104, and therefore through the entirety of the tool 100 when the valve of the tool 100 is actuated to an open position. As will be appreciated, and as illustrated herein, the nose assembly 104 can include a plurality of openings 105 extending through an interior volume and defining a fluid flow passage through the nose assembly 104. As further illustrated in FIG. 1, the fill-up and circulation tool 100 may further include a biasing member 109 disposed between the outer assembly 101 and the central assembly 102.

Figure 2:
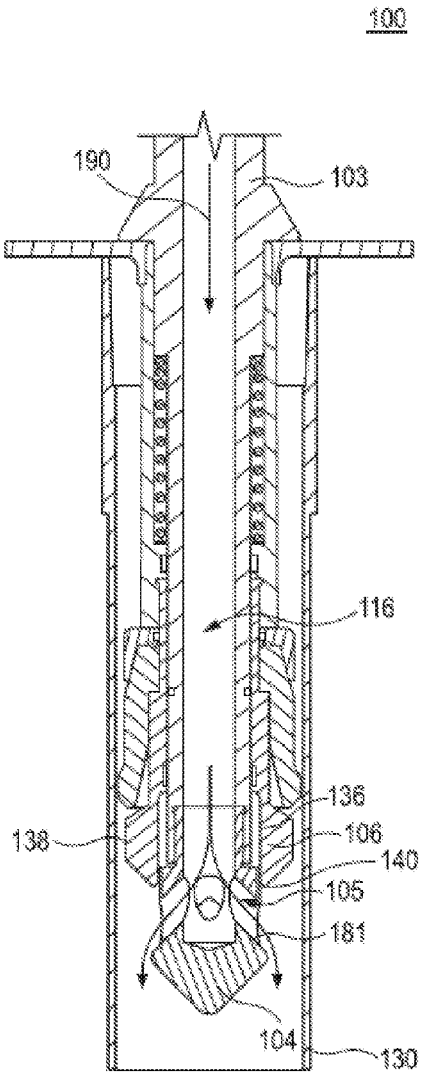
FIG. 2 includes a cross-sectional illustration of a fill-up and circulation tool in an open position in accordance with an embodiment.
Figure 3:
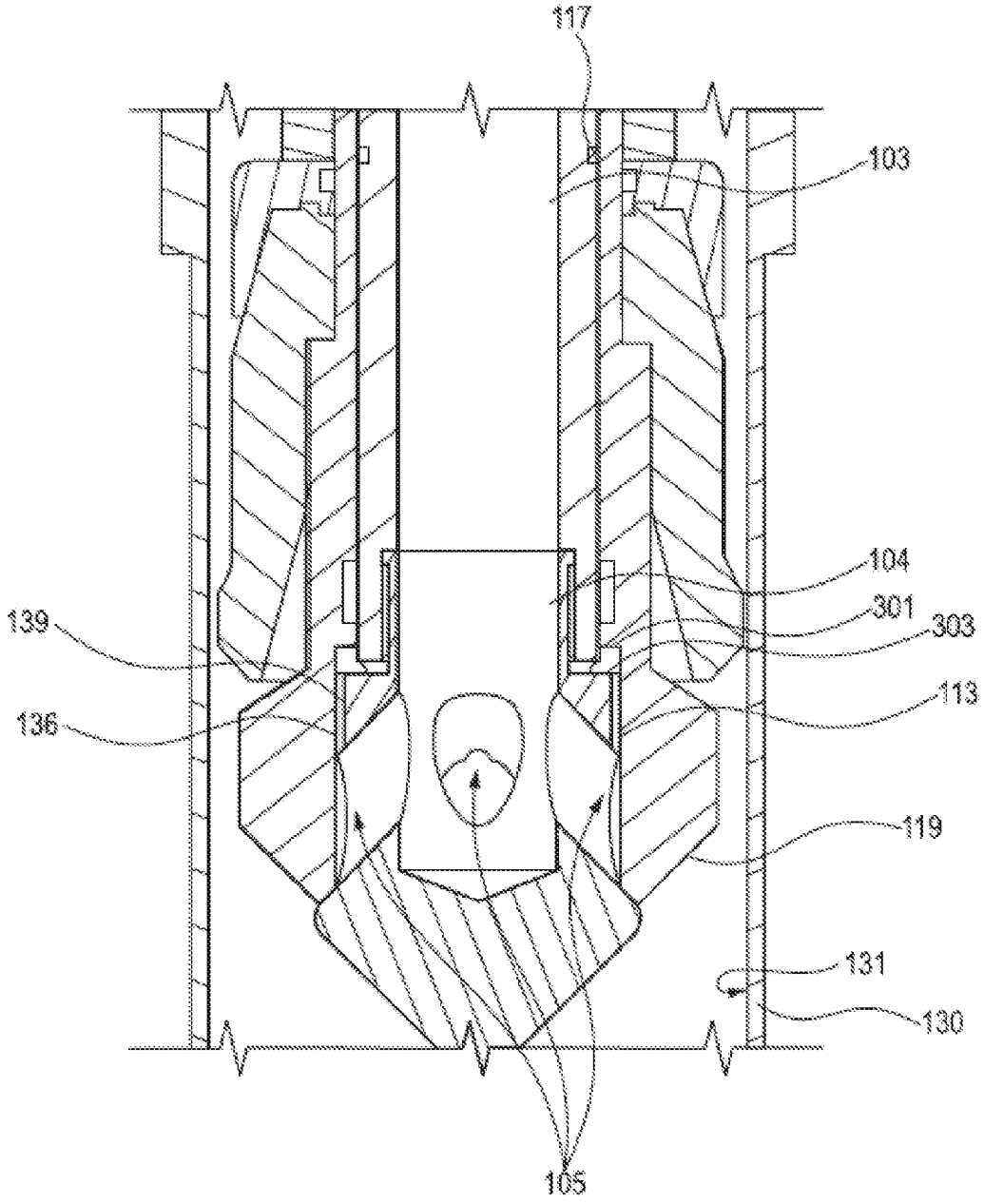
FIG. 3 includes a cross-sectional illustration of a portion of a fill-up and circulation tool and a closed position in accordance with an embodiment.

FIG. 2 includes a cross-sectional illustration of a fill-up and circulation tool in an open position in accordance with an embodiment. As illustrated, the fill-up and circulation tool 100 of FIG. 2 defines the open position of the valve. The position and relative movement between at least a portion of the outer assembly 101 relative to at least a portion of the central assembly 102 can define a valve configured to control the flow of fluid through the tool 100. In at least one embodiment, the fill-up and circulation tool 100 can include a valve that can be configured to change position between a closed position and an open position. More particularly, changing position between the closed position and the open position can include movement of the outer assembly 101 relative to the central assembly 102 in the longitudinal direction. In particular instances, the change in position between the closed position and the open position of the valve can include movement in the longitudinal direction 190 of the central assembly 102 relative to the outer assembly 101, such that an opening 105 in the nose assembly 104 can be exposed based on the movement of the outer assembly 101 relative to the central assembly 102. For example, as illustrated in FIG. 2, in the open position, the openings 105 of the nose assembly 104 are exposed, such that the openings 105 define an uninterrupted fluid flow path from the interior channel 116 of the mandrel 103 through the nose assembly 104 and into the interior of the tubular 130. In the open position, fluid can flow freely through the tool 100 and into the tubular.

In more particular instances, the change of position between the closed position and the open position can include longitudinal movement of the nose assembly 104 in the longitudinal direction 190 relative to at least a portion of the outer assembly 101. For example, actuation of the valve between a closed position and an open position can include longitudinal movement of the nose assembly 104 relative to the centralizer 106. In the particular embodiments illustrated in FIG. 1 and FIG. 2, the centralizer can be a part of the outer assembly 101 and the nose assembly 104 can be configured for movement relative to the centralizer 106, such that in the closed position, as illustrated in FIG. 1, the openings 105 of the nose assembly 104 are sealed against an interior surface of the centralizer 106. Thus, when the openings 105 are sealed (i.e., unexposed) the valve is in the closed position, and fluid contained in the interior channel 116 of the mandrel 103 does not flow through the tool 100. By contrast, when the fill-up and circulation tool 100 is actuated into an open position, the nose assembly 104 can be moved in a longitudinal direction 190 relative to the centralizer 106 such that the openings 105 are extended beyond the interior surface 136 of the centralizer 106, thus allowing fluid to pass freely through the interior channel 116 and openings 105 of the mandrel and 103 and nose assembly 104, respectively. It will be appreciated that the sealing interface does not necessarily need to intersect a surface openings, the sealing interface may be displaced a distance from the surfaces of the openings.

In accordance with an embodiment, the mandrel 103 can include an interior passage 116 extending from a distal end of the mandrel to a terminal end of the mandrel, and more particularly, defining a fluid flow passage through the interior of the mandrel 103. In accordance with a particular embodiment, in the open position, such as illustrated in FIG. 2, a fluid flow passage can extend through the entirety of the interior of the tool 100, and more particularly, through the interior of the mandrel 103 and the interior of the nose assembly 104.

In accordance with an embodiment, in the closed position a fluid flow passage can be terminated within the interior of the tool 100. More particularly, in a closed position, such as illustrated in FIG. 1, the fluid flow passage may terminate at a sealing interface between at least a portion of a surface of the opening 105 of the nose assembly 104 and a surface of the outer assembly 101, and more particularly, an interior surface 136 of the centralizer 106.

In particular instances, in the closed position, at least a portion of the opening 105 of the nose assembly 104 can be adjacent to an interior surface 136 of a portion of the outer assembly 101. In certain designs, at least a portion of the opening 105 of the nose assembly 104 can be adjacent to an interior surface 136 of the centralizer 106. In the open position, at least a portion of the opening 105 can be longitudinally displaced from the interior surface 136. For example, referring to FIG. 2, in an open position the interior surface 136 can be longitudinally displaced along the longitudinal axis 190 from the openings 105 for the nose assembly 104.

In another embodiment, the tool 100 may include a biasing member 109 that may be disposed between a portion of the outer assembly 101 and a portion of the central assembly 102. In particular instances, the biasing member 109 may include a spring. In a closed position the biasing member 109 may be configured to be in an initial state. In the initial state, the biasing member 109 may be in a relaxed state or in a partially-energized state, which for example, in the case of spring, may include partial compression of the spring. The initial state may, but need not necessarily include a complete and total compression of the biasing member 109. The initial state may be selected to facilitate proper actuation of the valve and operation of the tool 100 upon insertion into the tubular 130. By contrast, in one embodiment, upon actuation of the valve from a closed position to an open position, the biasing member 109 can be configured to change state from the initial state to a compressed state. In a compressed state, the biasing member 109 can be placed in a more energized state. For example, in the designs using a biasing member 109 in the form of a spring, the spring can be reduced in length along the longitudinal axis 190 and have greater compression than in the initial state.

In at least one embodiment, the biasing member 109 can be a spring having a spring constant of at least about 2 lbs/in and not greater than about 500 lbs/in.

In certain instances, actuation of the valve from an open position to a closed position can be facilitated by the use of the biasing member 109. In particular, changing position between the closed position and the open position may be based in part upon a difference in forces between a force applied to the biasing member 109 relative to a force applied in the opposite direction by a fluid contained in the central assembly 102, and more particularly a fluid contained within the interior channel 116 and openings 105 of the nose assembly.

In accordance with an embodiment, the tool 100 can further include an annular sealing channel 113, which may be disposed between a surface of the central assembly 102 and surface of the outer assembly 101 and configured to allow for longitudinal movement of at least a portion of the central assembly 102 relative to the outer assembly 101. In one design, the annular sealing channel 113 can define a gap between an interior surface 136 of the centralizer 106 and an exterior surface 139 of the nose assembly 104 and configured to allow for some fluid flow between the nose assembly 104 and the centralizer 106 while the valve is in the closed position.

Notably, for at least one embodiment, in the closed position, the annular sealing channel 113 can define a sealing channel volume (Vsc) between the surface of the central assembly 101 and a surface of the outer assembly 102. According to a particular embodiment, the annular sealing channel 113 may define a sealing channel volume (Vsc) between a surface of the nose assembly 104 and a surface of the outer assembly 101. The sealing channel volume can be configured to regulate the position of the central assembly 102 relative to the outer assembly 101 based on a pressure of fluid within the annular sealing channel 113. According to one embodiment, in the closed position, fluid may flow through the interior channel 116 into the nose assembly 104 through the openings 105 and into the annular sealing channel 113. When sufficient fluid flows into the annular sealing channel 113, including an upper portion 301 of the annular sealing channel 113, the fluid may apply opposing forces on the surfaces 303 of the nose assembly 104 and 301 of the outer assembly 101 and facilitate longitudinal movement of the central assembly 102 relative to the outer assembly 101, thus actuating the valve from the closed position to the open position. Notably, the movement of the central assembly 102 relative to the outer assembly 101 can also be described as movement of the corresponding assemblies away from each other, and not necessarily limited to one movement of one of the assemblies while the other is stationary.

In a non-limiting embodiment, the annular sealing channel 113 can have a sealing channel volume of at least about 0.1 cubic inches and not greater than about 1 US gallon.

In particular instances, the valve can be configured to be biased to the closed position until a predetermined pressure difference is exceeded between a pressure applied by a fluid in the central assembly 102 relative to an atmospheric pressure outside of the tool 100 and tubular. In a forward fluid flow situation, wherein fluid flows through the interior channel 116 and through the openings 105 of the nose assembly 104 and into the tubular 130, when the pressure within the sealing channel 113 exceed the pressure outside of the tool (i.e., in the tubular and the atmospheric pressure), the valve changes from a closed position to an open position creating a forward fluid flow situation. Notably, the present tool also facilitates control to fluid flow in a reverse fluid flow situation. In a situation where the valve is in the closed position, and there is pressure trapped inside the tubular there is a means to actuate the valve. The pressure within the tubular can create an upward force on the outer assembly 101, such that when a certain pressure is reached, it will overcome the force of the biasing member 109, and facilitate movement of the outer assembly 101 relative to the central assembly 102 and thus open the valve and allow fluid to flow from the tubular 130 through the openings 405 and into the interior channel 115, defining reverse fluid flow situation. In such reverse fluid flow situations, at least a portion of the outer assembly 101, such as an outer annular surface 119 of the centralizer 106, can be acted upon by the fluid and configured to allow the actuation of the valve from a closed position to an open position an allow reverse fluid flow through the tool 100. The reverse fluid flow capabilities of the tool 100 can save leakage of fluid into the working environment, which would otherwise create potentially hazardous conditions.

In accordance with an embodiment, in a closed position, the valve can have a sealing ratio (Fb/Ff) of at least about 1, wherein Fb represents a force configured to be applied by the biasing member against the central assembly and Ff represents a force configured to be applied by a fluid contained in the central assembly 102 against the outer assembly 101. Moreover, in an open position the sealing ratio (Fb/Ff) can be less than 1, and more particularly, not greater than about 0.99.

In accordance with another embodiment, the tool 100 can include a push plate 110 coupled to the outer assembly 101 and configured to engage a portion of the mandrel 103 in the open position. Notably, the push plate 110 may be the primary mechanism facilitating actuation of the tool from an open position to a closed position. Notably, the push plate can engage a portion of the tubular and facilitate relative motion between the central assembly 102 and outer assembly 102, and facilitate moving the tool from the closed position to an open position. In limited circumstances wherein the push plate 110 may not be used in a proper manner to facilitate suitable actuation of the tool from a closed position to a fully closed position, the sealing channel 113 can facilitate full actuation of the tool to an open position as a failsafe mechanism.

More particularly, in the open position, such as illustrated in FIG. 2, the push plate 110 can engage a protrusion 111 of the mandrel 103, more particularly a stop surface 112 of the protrusion 111 of the mandrel 103. Utilization of a mandrel 103 incorporating a protrusion 111 can facilitate controlled longitudinal movement of the outer assembly 101 relative to the central assembly 102 and controlled actuation of the valve between the open position and closed position.

The tool 100 may further include a terminal end screw 123, which can be disposed between a terminal end of the mandrel 103 and a surface of the nose assembly 104. In particular instances, the terminal end screw 123 may facilitate failsafe coupling of the mandrel 103 to the nose assembly 104 to ensure maintaining a proper coupling between the mandrel 103 and nose assembly 104 for reasons of safety.

The tool 100 may further include an upper annular seal 117 disposed between a portion of the outer assembly 101 and central assembly 102. In particular instances, the upper annular seal 117 can have an annular shape, defining a central opening, wherein a portion of the central assembly 102 is configured to extend through the central opening of the upper annular seal 117. More particularly, the upper annular seal 117 can be disposed on an outer surface of the mandrel 103 such that it is disposed between an outer surface of the mandrel 103 an interior surface of a portion of the outer assembly 101, and more particularly, a surface of the centralizer 106. In one particular instance, the upper annular seal 117 may be spaced apart from the annular sealing channel 113 along the longitudinal axis 190.

In certain embodiments, the nose assembly 104 may include a nose assembly seal disposed between a surface of the outer assembly 101 and a surface of the nose assembly 104. For example, in one embodiment, the nose assembly 104 may include a seal disposed at the sealing interface 118 between the nose assembly 104 and centralizer 106. Notably, in the closed position, a terminal surface 140 of the centralizer 106 can be configured to be in contact with a sealing surface 181 of the nose assembly 104. The sealing surface 181 may include an intermediate component in the form of a nose assembly seal configured to abut the terminal surface 140 of the centralizer in the closed position. In the open position, the terminal surface 140 of the centralizer 106 can be configured to be spaced apart along longitudinal axis 190 from the sealing surface 181 of the nose assembly 104.

In one particular instance, the tool 100 can be formed such that it facilitates free rotation of the outer assembly 101 relative to the central assembly 102. Free rotation of the outer assembly 101 relative to the central assembly 102 can facilitate free rotation of the outer assembly 101 during operation of the tool 100, which may be particularly useful when screwing engagement between tubulars is occurring and one wishes to maintain the tool 100 within one of the tubulars. Moreover, free rotation of the outer assembly 101 relative to the central assembly 102 can allow rotary motion of the outer assembly 101 without affecting the positioning of the tool 100 within a tubular and particularly the position of the central assembly 102 within the tubular 130.

Figure 4:
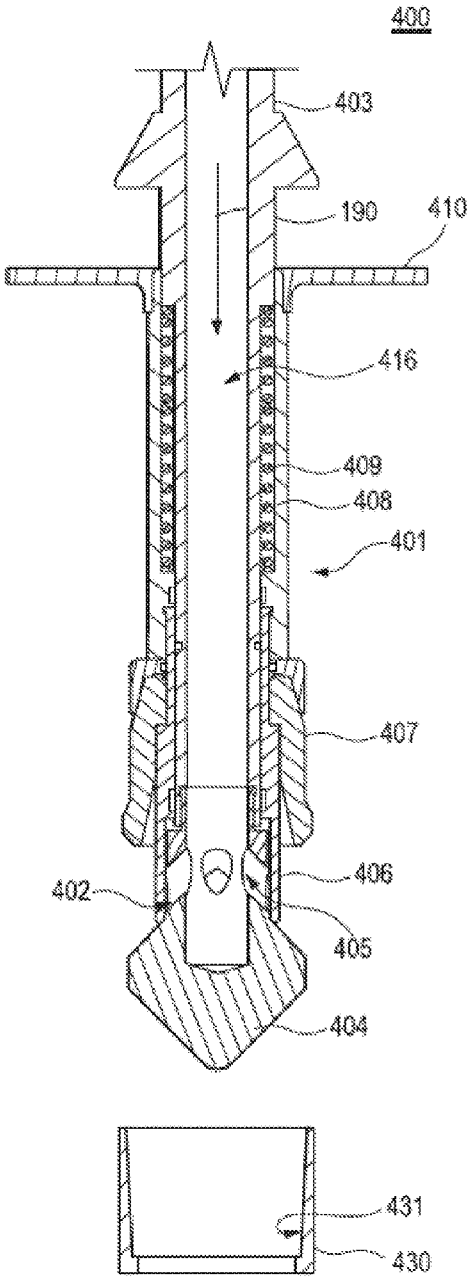
FIG. 4 includes a cross-sectional illustration of a fill-up and circulation tool in accordance with an embodiment.

While the centralizer is illustrated as being a part of the outer assembly 101 in FIG. 1 and FIG. 2, it will be appreciated that in alternative designs, other components may function as a centralizer. For example, referring briefly to FIG. 4, a cross-sectional illustration of a fill-up and circulation tool in a closed position in accordance with an alternative embodiment is provided. In further detail, as illustrated in FIG. 4, the fill-up and circulation tool 400 can include an outer assembly 401 coupled to a central assembly 402. In the illustrated embodiment, the central assembly 402 may include a nose assembly 404 having a relative size larger than other components to facilitate function as a centralizer, and facilitating centralizing the tool 400 within the tubular 430. In accordance with an embodiment, the outer assembly 401 may include a sealing sleeve 406 coupled to the nose assembly 404. In accordance with an embodiment, the sealing sleeve 406 may be a generally cylindrical body having flanges configured to extend over the openings 405, when the tool 400 is in the closed position.

In another embodiment as illustrated in FIG. 4, the outer assembly 401 may also include a packer 407 extending around at least a portion of the sealing sleeve 406. As further illustrated, in certain embodiments, the tool 400 can include a packer 407 as part of the outer assembly 401. In certain instances, the packer 407 can be configured to form a seal between an interior surface 431 of the tubular 430 and the outer surface of the packer 407 to facilitate proper delivery of a fluid into the tubular 430 and limiting leakage of the fluid out of the tubular 430 at the insertion point of the tool 400.

In particular embodiments, the outer assembly 401 can include a packer 407 disposed around at least a portion of the mandrel 403. More particularly, the packer 407 can have an outer diameter, defined as the largest diameter of the packer 407 through the center of the tool and perpendicular to the longitudinal axis 190, which can be greater than an outer diameter of sealing sleeve 406. Such design can facilitate proper coupling of the outer surface of the packer and the interior surface 431 of the tubular 430 and proper formation of a seal upon insertion of the tool 400 in the tubular 430.

For certain designs, the tool 400 as illustrated in FIG. 4, may include other features of the embodiments described herein, including for example, but not limited to a sleeve 408 coupled to the packer 407 and a push plate 410 coupled to a distal end of the sleeve 408.

As further illustrated in FIG. 4, the central assembly 402 may include a mandrel 403 having an internal passage 416 extending longitudinally through the length of the mandrel 403 from a distal end to a terminal end of the mandrel 403. The mandrel 403 can be configured to facilitate flow of fluid through the interior channel 416. As further illustrated, the central assembly 402 can further include a nose assembly 404 coupled to a terminal end of the mandrel 403. Notably, the nose assembly 404 can include openings 405 configured to facilitate the flow of fluid from the nose assembly 404, and therefore through the entirety of the tool 400 when the valve of the tool 400 is actuated to an open position. As will be appreciated, and as illustrated herein, the nose assembly 404 can include a plurality of openings 405 extending through an interior volume and defining a fluid flow passage through the nose assembly 404. As further illustrated in FIG. 4, the fill-up and circulation tool 400 may further include a biasing member 409 disposed between the outer assembly 401 and the central assembly 402.

Figure 5:
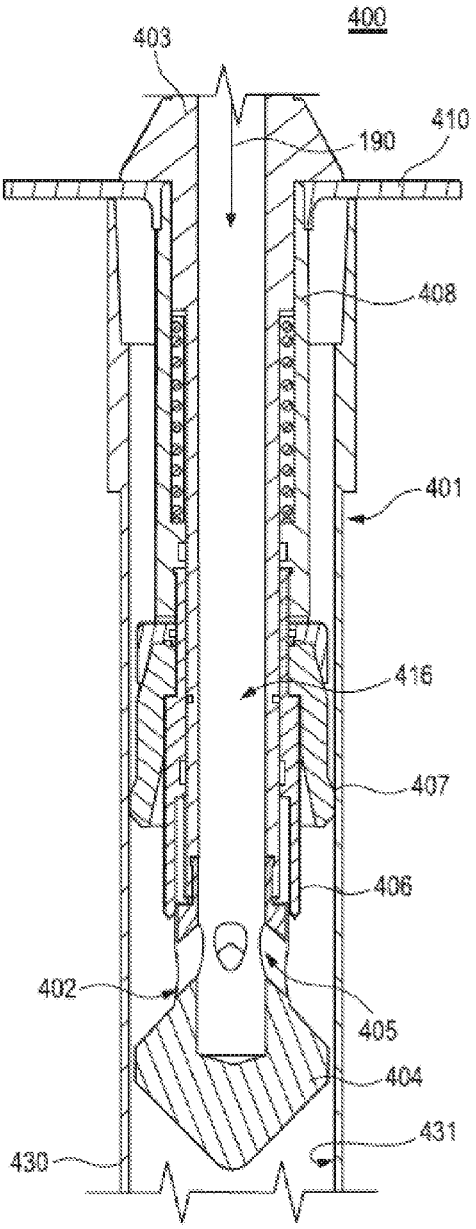
FIG. 5 includes a cross-sectional illustration of a fill-up and circulation tool in accordance with an embodiment.

FIG. 5 includes a cross-sectional illustration of a fill-up and circulation tool in an open position in accordance with an embodiment. As illustrated, the fill-up and circulation tool 400 of FIG. 5 defines the open position of the valve. The position and relative movement between at least a portion of the outer assembly 401 relative to at least a portion of the central assembly 402 can define a valve configured to control the flow of fluid through the tool 400. In at least one embodiment, the fill-up and circulation tool 400 can include a valve that can be configured to change position between a closed position and an open position. More particularly, changing position between the closed position and the open position can include movement of the outer assembly 401 relative to the central assembly 402 in the longitudinal direction 190. In particular instances, the change in position between the closed position and the open position of the valve can include movement in the longitudinal direction 190 of the nose assembly 404 relative to the outer assembly 401, such that an opening 405 in the nose assembly 404 can be exposed. For example, as illustrated in FIG. 5, in the open position, the openings 405 of the nose assembly 404 are exposed, such that the openings 405 define an uninterrupted fluid flow path from the interior channel 416 of the mandrel 403 through the nose assembly 404 and into the interior of the tubular 430. In the open position, fluid can flow freely through the tool 400 and into the tubular.

In more particular instances, the change of position between the closed position and the open position can include longitudinal movement of the nose assembly 404 in the longitudinal direction 190 relative to at least a portion of the sealing sleeve 406. In the particular embodiments illustrated in FIG. 4 and FIG. 5, in the closed position, as illustrated in FIG. 4, the openings 405 of the nose assembly 404 can be sealed against an interior surface of the sealing sleeve 406. Thus, when the openings 405 are sealed (i.e., unexposed) the valve is in the closed position, and fluid contained in the interior channel 416 of the mandrel 403 does not flow through the tool 400. By contrast, when the fill-up and circulation tool 400 is actuated into an open position, the nose assembly 404 can be moved in a longitudinal direction 190 relative to the sealing sleeve 406 such that the openings 405 are extended beyond the interior surface of the sealing sleeve, thus allowing fluid to pass freely through the interior channel 416 and openings 405 of the mandrel and 403 and nose assembly 404, respectively.

Figure 6:
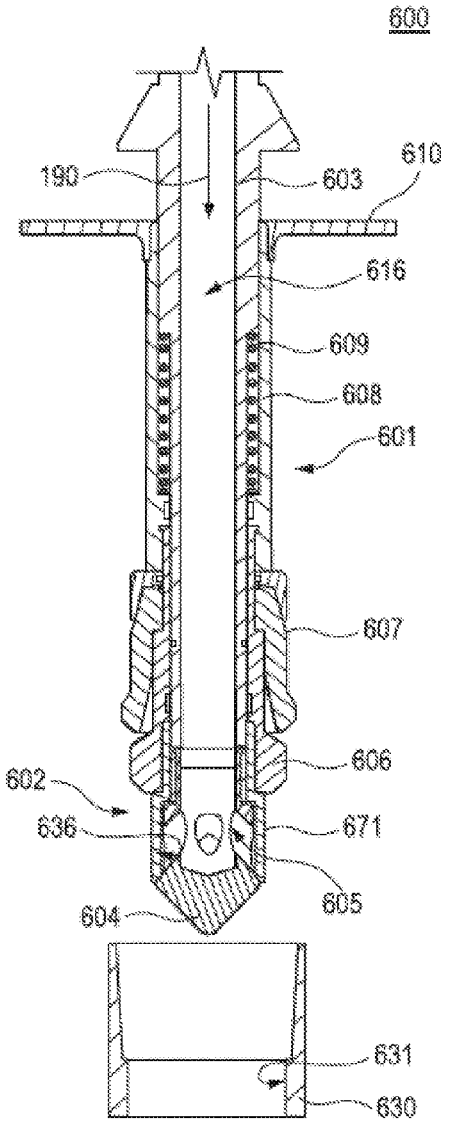
FIG. 6 includes a cross-sectional illustration of a fill-up and circulation tool in accordance with an embodiment.

FIG. 6 includes a cross-sectional illustration of a fill-up and circulation tool in a closed position in accordance with an alternative embodiment. In further detail, as illustrated in FIG. 6, the fill-up and circulation tool 600 can include an outer assembly 601 coupled to a central assembly 602. In the illustrated embodiment, the outer assembly 601 may include a centralizer 606. In accordance with an embodiment, the centralizer 606 may be coupled to the outer assembly 601, and more particularly, may be a component making up the outer assembly 601. In accordance with an embodiment, the centralizer 606 may be a generally cylindrical body having flanges configured to extend over openings 605, when the tool 600 is in the closed position.

In another embodiment as illustrated in FIG. 6, the outer assembly 601 may also include a packer 607 extending around at least a portion of the centralizer 606 and configured to have any of the same features and functions of packers described in the embodiments here. In particular embodiments, the outer assembly 601 can include a packer 607 disposed around at least a portion of the mandrel 603. More particularly, the packer 607 can have an outer diameter, defined as the largest diameter of the packer 607 through the center of the tool and perpendicular to the longitudinal direction 190, which can be greater than an outer diameter of centralizer 606. Such design can facilitate proper coupling of the outer surface of the packer and the interior surface 631 of the tubular 630 and proper formation of a seal upon insertion of the tool 600 in the tubular 630.

For certain designs, the tool 600 as illustrated in FIG. 6, may include other features of the embodiments described herein, including for example, but not limited to, a sleeve 608 coupled to the packer 607 and a push plate 610 coupled to a distal end of the sleeve 608.

As further illustrated in FIG. 6, the central assembly 602 may include a mandrel 603 having an internal passage 616 extending longitudinally through the length of the mandrel 603 from a distal end to a terminal end of the mandrel 603. The mandrel 603 can be configured to facilitate flow of fluid through the interior channel 616. As further illustrated, the central assembly 602 can further include a nose assembly 604 coupled to a terminal end of the mandrel 603. Notably, the nose assembly 604 can include openings 605 configured to facilitate the flow of fluid from the nose assembly 604, and therefore through the entirety of the tool 600 when the valve of the tool 600 is actuated to an open position. As will be appreciated, and as illustrated herein, the nose assembly 604 can include a plurality of openings 605 extending through an interior volume and defining a fluid flow passage through the nose assembly 604. As further illustrated in FIG. 6, the fill-up and circulation tool 600 may further include a biasing member 609 disposed between the outer assembly 601 and the central assembly 602.

Moreover, the central assembly 602 may include an intermediate component 671, which can be coupled to a portion of the outer assembly. In particular, the intermediate component 671 can be disposed between the nose assembly 604 and the centralizer 606. According to one design, the intermediate component 671 can be directly connected to at least an interior surface of the centralizer 606. Moreover, in the closed position illustrated in FIG. 6, at least a portion of a surface of the intermediate component 671 can be in direct contact with at least a portion of the nose assembly 604, and configured to form a seal between the contacting surfaces of the intermediate component 671 and nose assembly 604, and defining a closed position of the valve. In such embodiments, the surfaces of the centralizer 606 and nose assembly 604 may not necessarily come in direct contact to form a sealing interface.

Figure 7:
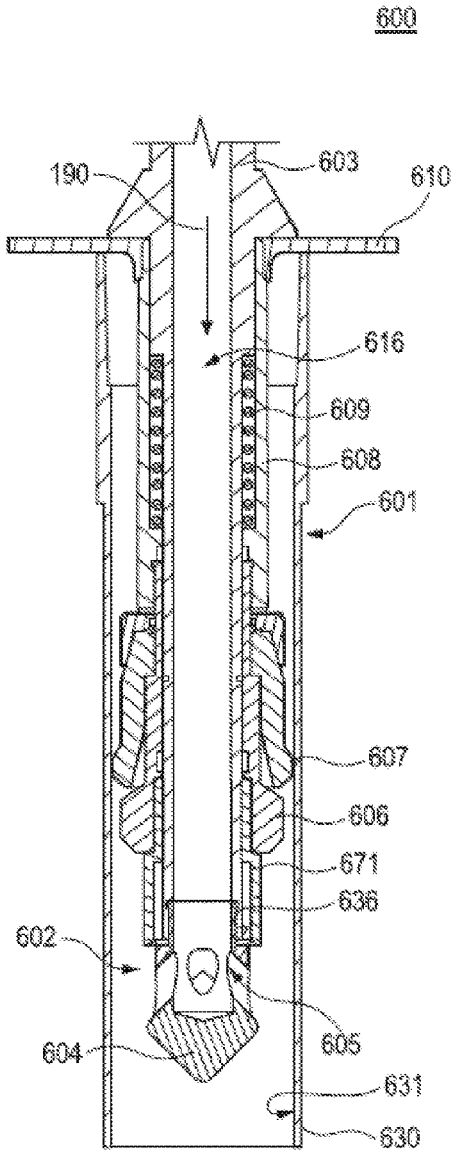
FIG. 7 includes a cross-sectional illustration of a fill-up and circulation tool in accordance with an embodiment.

FIG. 7 includes a cross-sectional illustration of the fill-up and circulation tool of FIG. 6 in an open position in accordance with an embodiment. As illustrated, the fill-up and circulation tool 600 of FIG. 7 defines the open position of the valve. The position and relative movement between at least a portion of the outer assembly 601 relative to at least a portion of the central assembly 602 can define a valve configured to control the flow of fluid through the tool 600. In at least one embodiment, the fill-up and circulation tool 600 can include a valve that can be configured to change position between a closed position and an open position. More particularly, changing position between the closed position and the open position can include movement of the outer assembly 601 relative to the central assembly 602 in the longitudinal direction 190. In particular instances, the change in position between the closed position and the open position of the valve can include movement in the longitudinal direction 190 of the nose assembly 604 relative to the intermediate component 671, such that an opening 605 in the nose assembly 604 can be exposed. For example, as illustrated in FIG. 7, in the open position, the openings 605 of the nose assembly 604 are exposed, such that the openings 605 define an uninterrupted fluid flow path from the interior channel 616 of the mandrel 603 through the nose assembly 604 and into the interior of the tubular 630. In the open position, fluid can flow freely through the tool 600 and into the tubular.

In more particular instances, the change of position between the closed position and the open position can include longitudinal movement of the nose assembly 604 in the longitudinal direction 190 relative to at least a portion of the intermediate component 671. In the particular embodiments illustrated in FIG. 6 and FIG. 7, in the closed position, as illustrated in FIG. 6, the openings 605 of the nose assembly 604 can be sealed against at least a portion of an interior surface 636 of the intermediate component 671. Thus, when the openings 605 are sealed (i.e., unexposed), the valve is in the closed position, and fluid contained in the interior channel 616 of the mandrel 603 does not flow through the tool 600. By contrast, when the fill-up and circulation tool 600 is actuated into an open position, such as shown in FIG. 7, the nose assembly 604 can be moved in a longitudinal direction 190 relative to the intermediate component 671, and also in some instances, the centralizer 606 to which the intermediate component 671 may be directly attached, such that the openings 605 extend beyond the interior surface 636 of the intermediate component 671, thus allowing fluid to pass freely through the interior channel 616 and openings 605 of the mandrel and 603 and nose assembly 604, respectively.

The above-disclosed subject matter is to be considered illustrative, and not restrictive, and the appended claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

The Abstract of the Disclosure is provided to comply with Patent Law and is submitted with the understanding that it will not be used to interpret or limit the scope or meaning of the claims. In addition, in the foregoing Detailed Description of the Drawings, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all features of any of the disclosed embodiments. Thus, the following claims are incorporated into the Detailed Description of the Drawings, with each claim standing on its own as defining separately claimed subject matter.

Item 1. A fill-up and circulation tool comprising: a central assembly including: a mandrel; and a nose assembly disposed at a terminal end of the mandrel; an outer assembly coupled to the central assembly; and a valve configured to change position between a closed position and an open position, wherein changing position between the closed position and the open position includes movement of the outer assembly relative to the central assembly.

Item 2. The fill-up and circulation tool of item 1, wherein the valve is configured to change position between a closed position and an open position when an opening in the nose assembly is exposed based on the relative movement of the outer assembly to the central assembly.

Item 3. The fill-up and circulation tool of item 1, wherein changing position between the closed position and the open position includes longitudinal movement of the central assembly relative to the outer assembly.

Item 4. The fill-up and circulation tool of item 1, wherein changing position between the closed position and the open position includes longitudinal movement of the nose assembly relative to the outer assembly.

Item 5. The fill-up and circulation tool of item 1, wherein changing position between the closed position and the open position includes longitudinal movement of the nose assembly relative to a centralizer.

Item 6. The fill-up and circulation tool of item 5, wherein the outer assembly includes the centralizer.

Item 7. The fill-up and circulation tool of item 5, wherein the central assembly includes the centralizer.

Item 8. The fill-up and circulation tool of item 1, wherein the mandrel comprises an interior passage defining a portion of a fluid flow passage.

Item 9. The fill-up and circulation tool of item 1, wherein in the open position a fluid flow passage extends through the entirety of the tool.

Item 10. The fill-up and circulation tool of item 1, wherein in the closed position a fluid flow passage is terminated within the interior of the tool.

Item 11. The fill-up and circulation tool of item 1, wherein the nose assembly comprises an opening configured to change position relative to the outer assembly with a change in position of the valve between a closed position and an open position.

Item 12. The fill-up and circulation tool of item 11, wherein in a closed position at least a portion of the opening is adjacent an interior surface of a centralizer.

Item 13. The fill-up and circulation tool of item 11, wherein in an open position the opening is longitudinally displaced from an interior surface of a centralizer.

Item 14. The fill-up and circulation tool of item 11, wherein in an open position the opening is longitudinally displaced from an interior surface of an intermediate component.

Item 15. The fill-up and circulation tool of item 1, wherein the nose assembly comprises a plurality of openings extending through an interior volume and defining a fluid flow passage through the nose assembly.

Item 16. The fill-up and circulation tool of item 1, further comprising a centralizer coupled to the outer assembly and configured to align the tool within a tubular.

Item 17. The fill-up and circulation tool of item 1, wherein the outer assembly further comprises a packer configured form a seal between the tool and an inner surface of a tubular.

Item 18. The fill-up and circulation tool of item 1, further comprising a biasing member disposed between a portion of the outer assembly mandrel and a portion of the central assembly.

Item 19. The fill-up and circulation tool of item 18, wherein in the closed position the biasing member is configured to be in an initial state.

Item 20. The fill-up and circulation tool of item 18, wherein changing position between the closed position and the open position is based upon a difference in forces between a force applied by a biasing member relative to a force applied in the opposite direction by a fluid contained in the central assembly.

What is claimed is:

1. A fill-up and circulation tool comprising:

a central assembly including:

a mandrel; and a nose assembly disposed at a terminal end of the mandrel, the nose assembly including an opening;

an outer assembly coupled to the central assembly;

a biasing member disposed between a portion of the outer assembly and a portion of the central assembly:

a valve configured to change position between a closed position and an open position based on movement of the biasing member from an initial stale to a compressed state, wherein changing position between the closed position and the open position includes relative movement of the outer assembly to the central assembly including the nose assembly and wherein the opening in the nose assembly Is configured to be exposed based on the relative movement of the outer assembly to the central assembly including movement of the biasing member from the initial state to the compressed state.

2. The fill-up and circulation tool of claim 1, wherein changing position between the closed position and the open position includes longitudinal movement of the central assembly relative to the outer assembly.

3. The fill-up and circulation tool of claim 1, wherein changing position between the closed position and the open position includes longitudinal movement of the nose assembly relative to the outer assembly.

4. The fill-up and circulation tool of claim 1, wherein changing position between the closed position and the open position includes longitudinal movement of the nose assembly relative to a centralizer.

5. The fill-up and circulation tool of claim 4, wherein the outer assembly includes the centralizer.

6. The fill-up and circulation tool of claim 1, wherein changing position between the closed position and the open position includes longitudinal movement of the nose assembly relative to a sealing sleeve.

7. The fill-up and circulation tool of claim 1, wherein the mandrel comprises an interior passage defining a portion of a fluid flow passage.

8. The fill-up and circulation tool of claim 1, wherein in the open position a fluid flow passage extends through the entirety of the tool.

9. The fill-up and circulation tool of claim 1, wherein in the closed position a fluid flow passage is terminated within the interior of the tool.

10. The fill-up and circulation tool of claim 1, wherein the opening of the nose assembly is configured to be exposed with a change in position of the valve between the closed position and the open position.

11. The fill-up and circulation tool of claim 10, wherein in the closed position at least a portion of the opening is adjacent an interior surface of a centralizer.

12. The fill-up and circulation tool of claim 10, wherein in the open position the opening is longitudinally displaced from an interior surface of a centralizer.

13. The fill-up and circulation tool of claim 10, wherein in the open position the opening is longitudinally displaced from an interior surface of a component positioned proximate an end of the outer assembly.

14. The fill-up and circulation tool of claim 1, wherein the nose assembly comprises a plurality of openings defining a fluid flow passage through the nose assembly.

15. The fill-up and circulation tool of claim 1, further comprising a centralizer coupled to the outer assembly and configured to align the tool within a tubular.

16. The fill-up and circulation tool of claim 1, wherein the outer assembly further comprises a packer configured to form a seal between the tool and an inner surface of a tubular.

17. The fill-up and circulation tool of claim 1, wherein changing position between the closed position and the open position is based upon a difference in forces between a force applied by the biasing member relative to a force applied in the opposite direction by a fluid contained in the central assembly.

18. The fill-up and circulation tool of claim 1, wherein in the closed position the valve comprises a sealing ratio (Fb/Ff) of at least about 1, wherein Fb represents a force configured to be applied by the biasing member against the central assembly and Ff represents a force configured to be applied by a fluid contained in the central assembly against the outer assembly.

19. The fill-up and circulation tool of claim 1, wherein the outer assembly comprises a push plate configured to facilitate actuation of the valve from the closed position to the open position.

20. The fill-up and circulation tool of claim 19, wherein the push plate is configured to engage a portion of the mandrel in the open position.

* * * * *